United States Patent [19]

Hammelmann

[11] Patent Number: 4,840,548

[45] Date of Patent: Jun. 20, 1989

[54] HIGH PRESSURE PLUNGER PUMP

[76] Inventor: Paul Hammelmann, Zum Sundern 17, 4740 Oelde, Fed. Rep. of Germany

[21] Appl. No.: 173,153

[22] Filed: Mar. 24, 1988

[30] Foreign Application Priority Data

Mar. 24, 1987 [DE] Fed. Rep. of Germany ..... 3709611

[51] Int. Cl.[4] ..... F04B 19/02; F04B 21/02

[52] U.S. Cl. ..... 417/469; 417/570; 417/457; 417/296; 417/520

[58] Field of Search ..... 417/570, 457, 469, 507, 417/296, 508, 520, 558, 529

[56] References Cited

U.S. PATENT DOCUMENTS 4,102,611 7/1978 Bröker ..... 417/559

4,146,355 3/1979 Bröker ..... 417/457

4,173,435 11/1979 Hammelmann ..... 417/457

*Primary Examiner*—Carlton R. Croyle

*Assistant Examiner*—Robert Blackmon

*Attorney, Agent, or Firm*—Michael J. Striker

[57] ABSTRACT

A high pressure plunger pump comprises a centrally arranged pressure valve, an oscillatingly movable plunger, a sleeve guided on the plunger and limiting a working chamber, a suction pump which surrounds the sleeve and accommodates an aspirated fluid, the sleeve having a ring chamber which opens towards the plunger, and a bush which is arranged in the ring chamber and supported against the plunger, the bush abutting against the plunger.

7 Claims, 3 Drawing Sheets

HIGH PRESSURE PLUNGER PUMP

BACKGROUND OF THE INVENTION

The present invention relates to a high pressure plunger pump. More particularly, it relates to a high pressure plunger pump with a centrally arranged pressure valve, a plunger movable by an oscillating drive and limiting a working chamber, a sleeve which is exclusively guided by the plunger and surrounded by a suction chamber accommodating the aspirating fluid.

High pressure plunger pumps of the above-mentioned general type are known in the art. In a known high pressure plunger pump, the sealing between the plunger and the sleeve which is floatingly supported on it is performed exclusively by the gap between both above-mentioned parts. This gap sealing is sufficient within a wide pressure region. However, with a working pressure which is greater than 2,000 bar, a loss of half displacement output occurs with the exclusive use of the gap sealing between the plunger and the sleeve arranged on it.

SUMMARY OF THE INVENTION

Accordingly, it is an object of the present invention to provide a high pressure plunger pump of the above-mentioned general type which eliminates the disadvantages of the prior art.

More particularly, it is an object of the present invention to provide a high pressure plunger pump which in condition of working pressures higher than 2,000 bar provides for a sufficient sealing between the plunger and the sleeve floatingly arranged on the plunger.

In keeping with these objects and with others which will become apparent hereinafter, one feature of the present invention resides, briefly stated, in that a ring chamber formed in the sleeve and opening to the plunger is provided with a stop bush or a metal one-piece sealing bush, wherein the stop bush or the sealing bush is supported on the plunger, and the sealing bush has an opening which extends toward the plunger and limits with the sleeve an additional ring chamber filled with leakage fluid and loaded with a pressure acting in the region of the opening.

The stop bush has a spring chamber provided with a pressure spring and opening to the plunger side. Leakage fluid penetrates into the spring chamber and its pressure acts, additionally to the force of the pressure spring, against a front supporting ring and against a pressure plate which limits the spring chamber at the rear end, so that the other parts of the stop bush are pressed at higher working pressure strongly against the plunger.

With the use of a one-piece sealing bush produced from metal, for example bronze, the ring chamber between the sealing bush and the sleeve is filled with leakage fluid under a pressure in the region of the opening which leads to the ring chamber, and the sealing bush is deformed in direction towards the plunger. The intensity of the deformation of the sealing bush is dependent on the working pressure of the pump.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
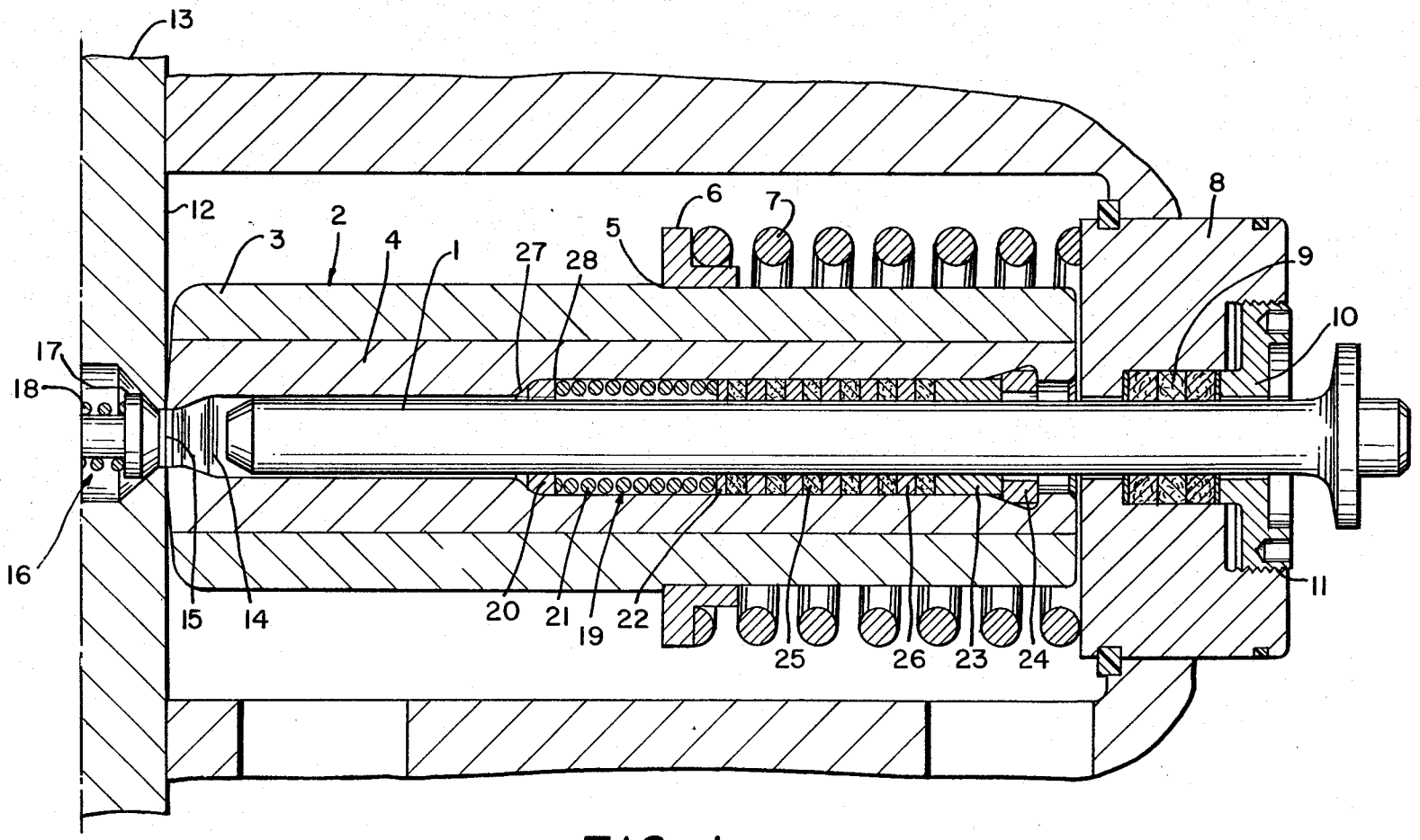
FIG. 1 is a view showing a longitudinal section of a high pressure plunger pump in accordance with the present invention, in which a sleeve floatingly supported on a plunger is provided with a stop bush.

A plunger of a high pressure plunger pump in accordance with the present invention is identified with reference numeral 1. The plunger 1 reciprocates between a front and a rear dead point by means of a not shown oscillating drive. The oscillating drive can be formed as a crank drive which drives the plunger through a double-holed capstan head.

A sleeve 2 is floatingly supported on the plunger. In the shown embodiment the sleeve 2 is composed of sleeve parts 3 and 4 fixedly connected with one another by a shrinkage process.

The sleeve part 3 is provided with an abutment shoulder 5. A supporting ring 6 having an angular cross-section abuts against the abutment shoulder 5 and is loaded with a spring 7. The other end of the spring 7 abuts against an insert ring 8. The ring 8 has a central opening through which the plunger 1 extends. The sealing in the region of this opening is performed by means of sealing packings 9. The latter are fixed by a pressure ring 10 in a ring chamber which opens toward the plunger. The pressure ring 10 is provided with an outer 22.

In the operating position shown in FIG. 1, the sleeve 2 is supported on a wall surface 12 of a pump head 13. The sleeve 2 limits a working chamber 14 of the high pressure plunger pump, which merges into an opening 15 of a pressure valve 16. A pressure valve body 17 of the pressure valve 16 is arranged centrally and loaded with a spring 18. The pressure valve body 17 is shown in FIG. 1 in the closed position.

The sleeve part 4 has a ring chamber 19 which is open toward the plunger. A stop bush is arranged in the ring chamber 19. The stop bush has a front supporting ring 20 produced for example from bronze. A cylindrical helical spring 21 abuts against the supporting ring 20 and is associated at the opposite end with a supporting plate 22. The other functional parts of the stop bush are held with a pre-stress under the action of the spring 21. A rear supporting ring 23 is associated with a split ring 24 formed as an abutment. A plurality of packing rings 25 and 26 are arranged between the supporting plate 22 and the supporting ring 23.

The front supporting ring 20 is rounded in the front outer region and abuts against an arcuate transition from a front end surface 27 to an outer limiting surface 28 of the ring chamber 19. Also, the transition from the front end surface 27 to a central opening of the sleeve part 4 is arcuate, so that under the action of high liquid pressure on the sleeve 2 no notch tension occurs.

The leakage fluid which penetrates into the receiving chamber for the spring 21 through the ring gap between the plunger and the sleeve part 4 during the working stroke of the plunger 1 forms in this chamber an additional pressure with which the remaining functional parts of the stop bush are pressed against the plunger so that the sealing is intensified.

Figure 2:
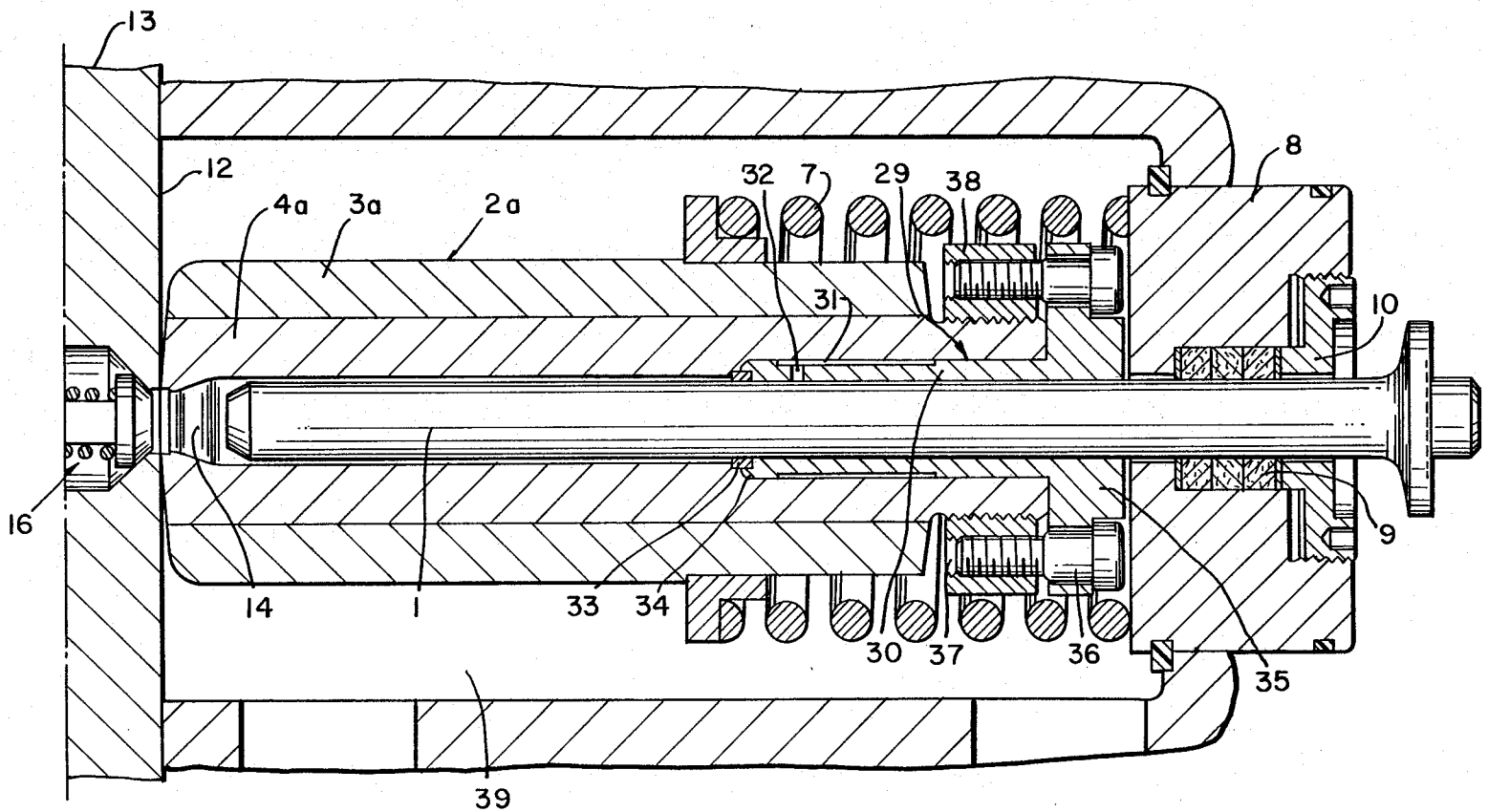
FIG. 2 is a longitudinal section of the high pressure plunger pump with a sealing bush associated with a plunger and formed as one-piece bush of metal.
Figure 3:
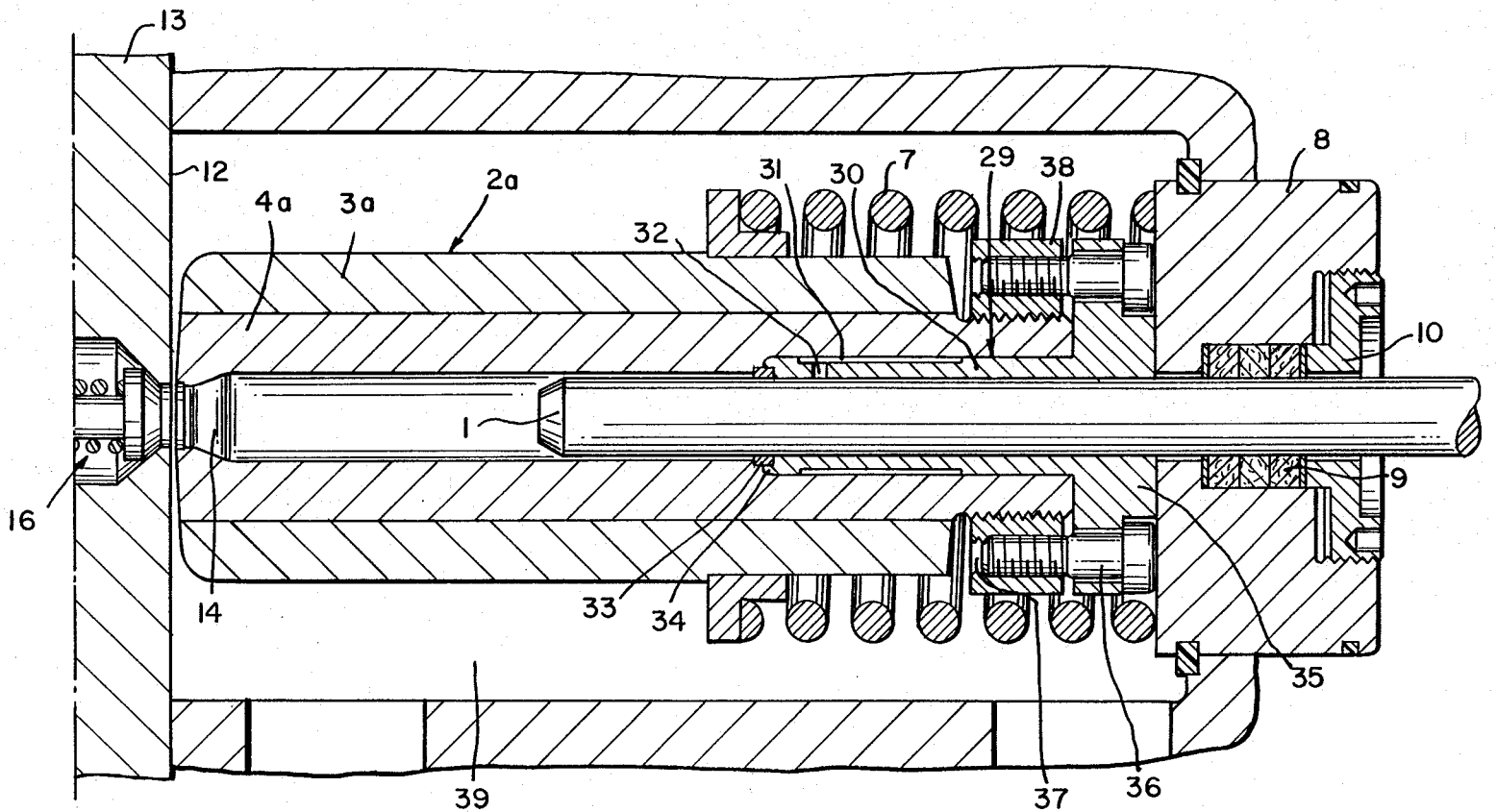
FIG. 3 is a longitudinal section of the high pressure plunger of FIG. 2 shown with the fluid intake open.

In the embodiment of FIG. 2 a sleeve 2*a* floatingly supported on the plunger 1 is composed of two sleeve parts 3*a* and 4*a*. The sleeve is associated with a spring 7 as in the embodiment of FIG. 1. The spring 7 is arranged so that the sleeve is pressed against the inner surface 12 of the pump head 13. The sleeve part 4*a* is provided with a ring chamber 29 which is open toward the side of the plunger 1. A one-piece sealing bush 30 of metal is arranged in the ring chamber 29. This sealing bush limits with the sleeve part 4*a* a ring chamber 31 from which an opening 32 extends in direction of the plunger 1 and opens into a ring gap between the plunger 1 and the sealing bush 30. The leakage fluid flowing from the working chamber 14 during the pressure stroke of the plunger through the gap between the plunger 1 and the sleeve 2*a* to the region of the opening 32 has a pressure which is smaller than the working pressure of the pump. The leakage fluid under this lower pressure, in the ring chamber 31, deforms the sealing bush 30 and improves the sealing between the sleeve and the plunger.

At the front end of the ring chamber 29 for receiving the sealing bush 30, a ring-shaped soft packing 33 is provided. It extends outwardly and inwardly beyond the end surface 34 of the ring chamber 29.

The sealing bush 30 has a ring flange 35 at its rear end. The ring flange 35 is formed as a mounting flange and provided with throughgoing openings for mounting screws 36. These mounting screws are screwed in threaded openings 37 of the ring 38 which is screwed on the sleeve part 4.

It can be seen from FIGS. 1 and 2 that the stop bush or the sealing bush is provided in the central and/or rear region of the sleeve 2, 2*a*. The aspirated liquid which is available in the suction chamber 39 flows around the sleeve 2, 2*a*.

When the plunger moves from the front dead point in direction toward the rear dead point, a negative pressure is formed in the working chamber 14 so that under the action of the supply pressure which acts in the suction chamber, the sleeve 2, 2*a* is moved back against the action of the spring 7 from the pump head. Thereby the front opening of the sleeve is released, so that the fluid can flow from the suction chamber 39 into the working chamber 14. During the pressure stroke of the plunger the sleeve 2, 2*a* assumes the position shown in FIGS. 1 and 2, in which the sleeve abuts with its front end surface against the surface 12 of the pump head 13.

The heat which is produced during the pressure stroke of the plunger is withdrawn through the sleeve 2, 2*a* into the fluid which flows around the sleeve.

It will be understood that each of the elements described above, or two or more together, may also find a useful application in other types of constructions differing from the types described above.

While the invention has been illustrated and described as embodied in a high pressure plunger pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A high pressure plunger pump, comprising a centrally arranged pressure valve; an oscillatingly movable plunger having an axis; a sleeve guided on said plunger and limiting a working chamber; a suction chamber which surrounds said sleeve and accommodates an aspirated fluid, said sleeve having a ring chamber which opens toward said plunger; and a bush which is arranged in said ring chamber and supported against said plunger, said bush abutting against the plunger, said bush being formed as a one-piece sealing bush composed of metal, said bush being provided with an opening extending towards said plunger and limiting with said sleeve an additional ring chamber which is filled with a leakage fluid and loaded with a pressure which acts in the region of said opening, said first-mentioned ring chamber having a front end and a front end surface; and further comprising a ring-shaped soft packing arranged at said front end of said first-mentioned ring chamber, said soft packing overlapping said front end surface and extending axially at both sides of said front end surface.

2. A high pressure plunger pump as defined in claim 1, wherein said bush which is arranged in said chamber of said sleeve is located in a central region of said sleeve.

3. A high pressure plunger pump as defined in claim 1, wherein said bush which is arranged in said ring chamber of said sleeve is located in a rear region of said sleeve.

4. A high pressure plunger pump as defined in claim 1, wherein said bush which is arranged in said ring chamber of said sleeve is located in a central and rear regions of said sleeve.

5. A high pressure plunger pump, comprising a centrally arranged pressure valve; an oscillatingly movable plunger having an axis; a sleeve guided on said plunger and limiting a working chamber; a suction chamber which surrounds said sleeve and accommodates an aspirated fluid, said sleeve having a ring chamber which opens toward said plunger; a bush which is arranged in said ring chamber and supported against said plunger, said bush abutting against the plunger, said bush being formed as a one-piece sealing bush composed of metal, said bush being provided with an opening extending towards said plunger and limiting with said sleeve an additional ring chamber which is filled with a leakage fluid and loaded with a pressure which acts in the region of said opening; a ring provided on said sleeve, said bush having a rear end provided with a ring flange connectable with said ring; and comprising means for connecting said ring flange of said bush with said ring of said sleeve.

6. A high pressure plunger pump as defined in claim 5, wherein said connecting means includes openings provided in said ring flange of said bush and in said ring of said sleeve, and threaded elements extending through said openings.

7. A high pressure plunger pump as defined in claim 5, wherein said ring is screwed on said sleeve.

* * * * *